United States Patent [19]

Coors

[11] 4,044,324

[45] Aug. 23, 1977

[54] COIL COMPRESSED PLUNGER CAVITY COMPONENTS FOR A WET TYPE SOLENOID

[75] Inventor: George Thom. Coors, Tipp City, Ohio

[73] Assignee: Ledex, Inc., Dayton, Ohio

[21] Appl. No.: 682,125

[22] Filed: Apr. 30, 1976

[51] Int. Cl.[2] ..... H01F 7/08

[52] U.S. Cl. ..... 335/260; 335/262

[58] Field of Search ..... 335/255, 260, 261, 262, 335/251

[56] References Cited

U.S. PATENT DOCUMENTS

| | | | |
|---|---|---|---|
| 2,952,756 | 9/1960 | Lanctot | 335/255 X |
| 3,588,039 | 6/1971 | Chelminiski et al. | 335/261 X |

*Primary Examiner*—George Harris

*Attorney, Agent, or Firm*—Biebel, French & Nauman

[57] ABSTRACT

A wet plunger solenoid is formed with a three-piece spool assembly including a base and a hub joined by a nonmagnetic sleeve. An electric coil is wound directly onto the sleeve to compress the sleeve about the telescopically interfitted base and hub parts to form a fluid-tight joint, thus forming an armature or plunger cavity which has high resistance to deformation when fluid pressure is applied to the interior. A fluid-tight joint is formed which is free of threaded connections and is reinforced by reason of the fact that the coil is wound in tension, and the cumulative compression effectively joins the parts into a unitary structure.

6 Claims, 3 Drawing Figures

COIL COMPRESSED PLUNGER CAVITY COMPONENTS FOR A WET TYPE SOLENOID

BACKGROUND OF THE INVENTION

This invention relates to solenoids and more particularly to solenoids adapted to operate spool-type hydraulic valves or the like in which the hydraulic fluid is permitted to enter into the plunger cavity of the solenoid. Such devices are commonly known in the trade as "wet plunger" solenoids.

Wet plunger solenoids have a distinct advantage over dry solenoids in the operation of spool-type valves and the like in that since the armature or plunger cavity is filled, no dynamic seal is employed between the plunger shaft and the housing, thus eliminating a source of friction during operation and further eliminating a source of possible leakage. However, in the past it has proven difficult to provide a sealed plunger or armature cavity which is, at the same time, a high pressure container. The walls of the plunger cavity have commonly been made as parts which are separate from the fluid seal, thus increasing the effective air gap. Further, wet plunger solenoids in the past have generally operated directly from alternating current and have been designed to operate in either of two limit positions and have not been designed for proportional actuation due to the difficulty of providing the required proportional pole pieces in a sealed cavity.

SUMMARY OF THE INVENTION

It is a primary object of the invention to provide a movable wet plunger type solenoid particularly adapted to operate hydraulic valves and the like in which the plunger cavity is formed by an integral joining of a magnetic base and a magnetic pole with a non-magnetic sleeve, and in which the parts are retained in assembled relation without welds or threaded joints by reason of the compressive effect of the electric winding.

The cavity is thus formed by a spool assembly which is suitably insulated for the electrical winding or wirings and the turns of the coil are applied directly to the spool assembly. The directly placed windings not only enhance the heat sink capability of the unit, but also compress the non-ferrous sleeve against the pole and the base by reason of the accumulative compression created from the tension on the wire during winding. Additionally, the fact that the coil is wound directly onto the spool assembly provides the unit with increased strength to withstand high internal pressures.

A close sliding fit between the cavity walls of the spool or coil assembly and the armature is assured by providing a plurality of longitudinally extending bearing strips which are inlaid or pressed into suitable grooves formed on the exterior of the armature and which, themselves, slide within the bore. The strips are formed of non-magnetic material and provide for a uniformly small air gap between the armature and the walls of the armature cavity.

An important object of the invention is the provision of a wet plunger type solenoid having a three-piece spool assembly including a magnetic base, a magnetic hub, and an interfitting non-magnetic sleeve in which cylindrical portions of the sleeve overlie corresponding cylinder portions of the base and the pole and form a close or press fit therewith, and in which the parts are retained in fluid-tight assembled relation by the cumulative compressive force of the coil being wound directly onto the sleeve, and in which the sleeve itself defines the magnetic gap between the pole and the base.

A further object of the invention is the provision of a spool or coil assembly for a solenoid in which a non-magnetic sleeve is telescopically fitted with respect to a base and at least one pole, and has an outer surface onto which an electric coil is wound in tension so that the sleeve is caused to be compressed about the base and the pole, thus increasing the strength of the assembly against deformation due to hydraulic pressure from within the armature cavity in the base of a wet plunger solenoid, and causing the base and pole to be tightly and firmly connected together in a unitary pool assembly. The latter advantage is also useful in the construction of a dry plunger solenoid.

A further object of the invention is the provision of a wet plunger-type of solenoid in which the electric coil is applied in such a manner as to substantially increase the resistance of the parts to deformation by reason of the application of hydraulic pressure to the armature cavity and to effect a fluid-type seal.

These and other objects and advantages of the invention will be apparent from the following description, the accompanying drawings and the appended claims.

DESCRIPTION OF THE PREFERRED EMBODIMENT

Figure 1:
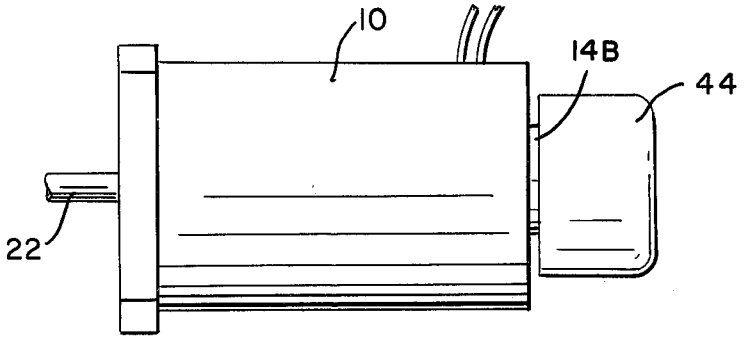
FIG. 1 is a side view of a solenoid according to this invention.
Figure 2:
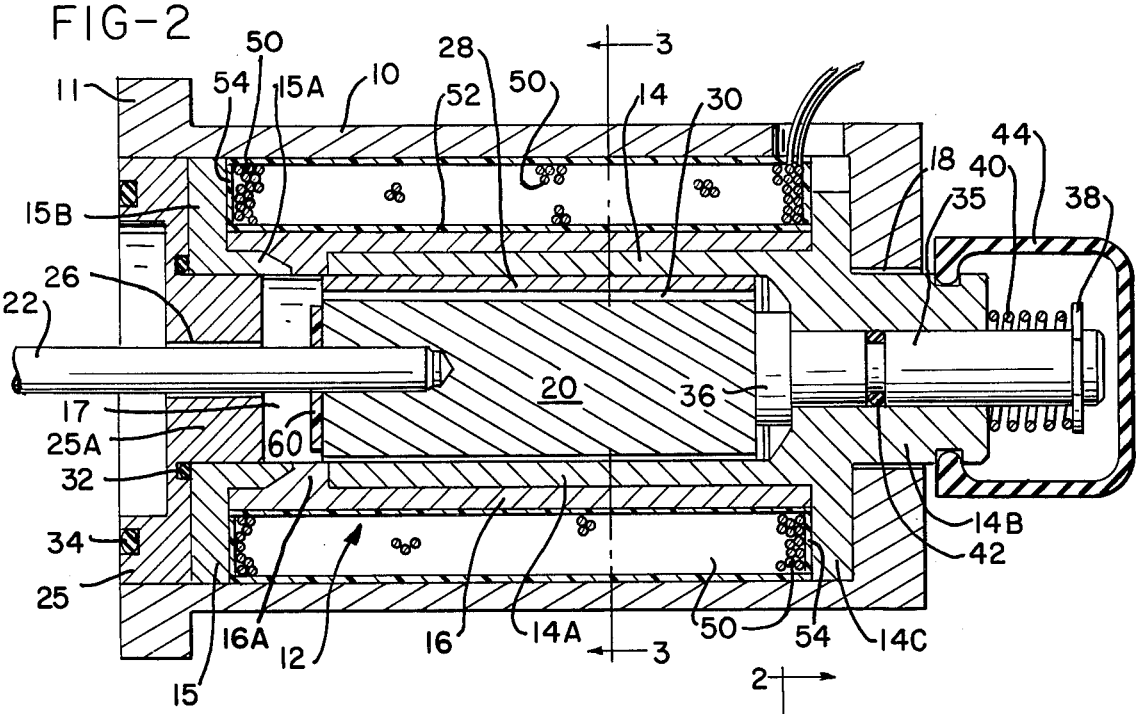
FIG. 2 is an enlarged longitudinal section through the solenoid taken generally along the line 2—2 of FIG. 3.
Figure 3:
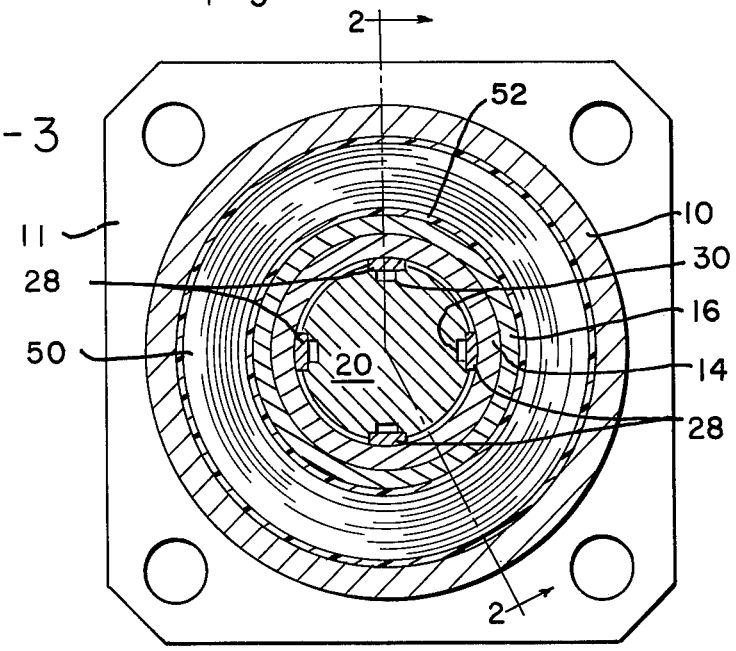
FIG. 3 is a transverse section taken generally along the line 3—3 of FIG. 2.

The solenoid of the present invention is housed in a generally cylindrical open-ended case 10 of magnetic material, formed with an annular front flange 11 at the open end thereof. The flange 11 is adapted for mounting onto a valve or the like, the position of the spool of which is to be controlled by the solenoid. The case 10 includes a coil or spool assembly indicated generally at 12 which in assembly, is inserted within the open end of the case 10.

The spool assembly 12 is made up of three pieces including a base 14, a pole 15 and a sleeve 16. The base 14 as well as the pole 15 are similarly formed of ferrous or other magnetic material. The base 14 is formed with an axially extending cylindrical portion **14*a* and a rearwardly extending portion 14*b*, the latter extending through a rear opening 18 formed in the case 10. The base 14 is further formed with an annular, radially extending shoulder 14*c* which defines one radial wall of a coil-receiving cavity. The inside surface of the cylindrical portion 14*a* forms an axial portion of an armature cavity 17**.

The pole 15 is spaced physically and magnetically from the base 14 and includes a cylindrical pole portion **15*a*, having an inside diameter which similarly forms an axial portion of the armature cavity 17 and of the same diameter as the inside diameter of the base portion 14*a*. Further, the pole 15 is provided with an annular, radially extending shoulder 15*b***, the inside surface of which forms the opposite wall of the coil-receiving cavity.

The sleeve 16 is formed of non-magnetic material such as aluminum or brass, and is fitted in telescopic relation as a press fit over the outside surface of the base portion 14*a* and into abutment with the shoulder 14*c*.

Similarly, the cylindrical pole portion 15*a* of the pole 15 is fitted in telescopic relation to the sleeve 16 as a close press fit.

The remote end of the sleeve 16 is in abutment with the adjacent wall of the shoulder portion 15*b*. Preferably, the fit between the sleeve and the base is also a close press fit. If desired, a suitable sealant may be applied to the interface between these parts.

The sleeve 16 is formed with a cylindrical portion 16*a* axially intermediate the base and the hub, bridging the space therebetween, and formed with an inside diameter essentially the same as that of the base and hub, thus forming an intermediate wall portion of the armature cavity 17.

A solenoid armature 20 formed of magnetic material is received within the cavity 17 of the spool assembly 12 for axial movement therein into coaction with the pole 15. A nonmagnetic shaft 22 extends axially from one end of the armature 20 by which the movement of the armature 20 is transmitted to the exterior of the solenoid. Commonly, the shaft 22 will be connected to operate the spool of a hydraulic valve or the like.

The interior armature cavity is closed by an end cap 25, the outer diameter of which is received within the case opening. The end cap 25 is provided with a central clearance opening 26 through which the shaft 22 extends while permitting hydraulic fluid under pressure to enter into the interior of the solenoid cavity. The armature 20 is held and guided in spaced relation from the cylindrical cavity walls by means of a plurality of longitudinally extending bearing strips 28, preferably four in number at 90° intervals, and pressed into longitudinal recesses formed within the armature. The upper surfaces of the strips 28 project a few one-thousands of an inch or less above the surface of the armature 20 and provide for the guidance of the armature within the cavity while assuring close magnetic coupling between the armature, the base and the pole. Longitudinal openings or passageways 30 are formed in underlying relation to the strips 28 and extend axially between the ends of the armature 20 to prevent hydraulic lock-up of the armature by permitting the flow of fluid therethrough from one end of the armature to the other as the armature moves axially within the solenoid.

The end cap 25 is statically sealed at the base 15 by an O-ring 32 on the inside face of the cap. An axial cylindrical portion 25*a* forms one wall of the interior cavity and defines an abutment for the armature 20, and is thus positioned radially within the pole portion 15*a*. An annular face seal 34 may be provided on the outside surface of the end cap 25 by means of which the end cap is sealed to a valve housing or the like.

It is common to provide external means by which the armature 20 may be moved for the purpose of operating the connected valve, and for this purpose a non-magnetic manual actuator 35 is received within the base extension 14*b*. The actuator is provided with an enlarged head 36 in the cavity 17 forming in effect an oposite axial abutment for the armature 20. The actuator 35 extends outwardly of the case 10, and supports a snap ring 38. A compression spring 40 is positioned between the ring 38 and the outer exposed surface of the base 14 to urge the actuator into its normally retracted position, as shown. The stem of the actuator is sealed to the base by means of an O-ring 42. An elastomeric boot 44 may be fitted to the remote end of the base portion 14*b* to cover the otherwise exposed end of the actuator 35.

In order to effectuate a high pressure coil subassembly 12 and to join and seal the sleeve 16 to the base 14 and the pole 15 in the regions where these parts are telescoped, the turns of an electric coil 50 are wound directly on the outer cylindrical surface of the sleeve 16. Preferably, a layer 52 of insulating tape is first applied to the outer surface and the turns of the electric coil are then wound directly onto the sleeve between the shoulder portions 14*c* and 15*b*, preferably while applying substantial tension to the wire during winding. Insulating washers 54 isolate the coil 50 from the shoulders 14*c* and 15*b*. The amount of tension employed can vary in accordance with the size of the wire employed and the strength of the wire. The accumulative effect of winding the turns of the coil 50 onto the sleeve 16 results in compression of the sleeve 16 about the telescopic portions of the pole 15 and the hub 14, assuring a fluid-tight joint therebetween, and at the same time, assisting materially in resisting the deflection of the spool assembly by reason of the application of fluid under pressure into the interior of the solenoid.

The elimination of the conventional coil form enhances the heat sink capacity of the solenoid. Thus, the turns of the coil 50 are in substantially closer heat transmitting relation to the sleeve 16 than would be the case where a coil form were used. Preferably, the sleeve 16 is made of a non-magnetic metal having a good heat conductivity, such as brass, to transmit the heat from the coil 50 to the adjacent structure of the solenoid. The arrangement is one in which a spool assembly is formed free of threaded joints by using economical slip fits. The sleeve 16 is actually in compression and firmly engages the interfitted base and pole. An assembly is formed which maintains its integrity up to 8000 psi or more, permitting continuous operation in the range of 3000 psi or more.

The cylindrical portion 15*a* of the pole 15 may be formed with any suitable configuration, such as the tapered form shown, to provide a desired linearity in operation. The tapered form shown has particular use as a proportional actuator, and is a preferred embodiment. It is preferred to form the end cap 25 of magnetic material to provide specific force curves or operating characteristics, in which case a non-magnetic spacer 60 keeps the armature 20 from completely closing the gap with the cap and becoming magnetically held. However, the cap 25 may also be made of non-magnetic material and the spacer 60 omitted. The solenoid may also be operated as a two-position unit, although the employment of the tapered pole section 15*a* permits the solenoid to be used as a proportional actuator.

The solenoid is free of any sliding or moving seals which impede the movement of the armature 20. The seals 32 and 34 are static and thus not subject to wear. The one moving seal 42 on the stem of the manual actuator 25 is infrequently used, does not impede the movement of the armature, and is not subject to appreciable wear.

By example only and without limitation, suitable solenoids in accordance with this invention have employed coils wound as follows:

A. 615 turns, No. 22 AWG conductor wound with 15 ounces of tension to provide a 12 volt DC unit, with 2.88 ohms resistance and 36 watts, one-quarter duty.

B. 1,204 turns, No. 25 AWG conductor wound with 15 ounces of tension to provide a 12 volt DC unit, with 11.39 ohms resistance and 9 watts, continuous duty.

C. 1,204 turns, No. 25 AWG conductor wound with 15 ounces of tension to provide a 24 volt DC unit, with 11.39 ohms resistance and 36 watts, one-quarter duty.

D. 2,420 turns, No. 28 AWG conductor wound with 12 ounces of tension to provide a 24 volt DC unit, with 45.86 ohms resistance and 9 watts, continuous duty.

E. 4,718 turns, No. 31 AWG conductor wound with 8 ounces of tension to provide a 110 volt AC unit, rectified to a 100 volt DC, with 179 ohms resistance and 36 watts, one-quarter duty.

F. 8,873 turns, No. 34 AWG conductor wound with 4 ounces of tension to provide a 110 volt AC unit, rectified to a 100 volt DC unit, with 673 ohms resistance and 9 watts, continuous duty.

The specific strength in psi attributed to the coil 50 on the sleeve 16 may be represented by the formula:

$$PSI = (2\ TS/I.D.) \times S.\ F.;$$

where

T = radial wall thickness of coil in inches,

S = yield strength of wire in pounds per square inch,

I. D. = inside diameter of coil 50 in inches, and

S. F. = space factor of wire.

Applying this formula to the above examples (A) - (F) provides the following theoretical burst strength increases in psi by reason of the coil 50 on the sleeve 16. (In each calculation T = 0.265 inch, S = 10,000 psi, I.D. = 0.845 inch and S. F. were as indicated.)

A. 4,272 psi with 22 AWG wire, S. F. = 0.6811
B. 4,186 psi with 25 AWG wire, S. F. = 0.6675
C. 4,186 psi with 25 AWG wire, S. F. = 0.6675
D. 4,191 psi with 28 AWG wire, S. F. = 0.6683
E. 4,084 psi with 31 AWG wire, S. F. = 0.6511
F. 3,829 psi with 34 AWG wire, S. F. = 0.6105

It will be noted that while tension, per se, is not a theoretical factor in calculating the burst strength provided of a coil, nevertheless the presence of tension is considered to be important since it results in the initial compression of the sleeve 16 and thus prestresses the sleeve about the interfitted base and pole regions, and the initial actual deflection of the spool assembly 12 within the operating range of the solenoid will be appreciably less than if the coil 50 were wound with minimum tension. Further, the compression effect advantageously forms a fluid-tight seal between these interfitting parts. In manufacture, it has been found that the ID of the cavity 17 will be somewhat decreased after the coil 50 is wound, at which time it may be suitably rebored or honed precisely to the desired dimension before the solenoid is finally assembled.

The elimination of the conventional coil form provides a solenoid construction which advantageously may be used in a conventional manner, that is, with a dry plunger. This is particularly the case in the construction of a proportional solenoid in which an axial portion of a cylindrical pole is selectively saturated by the movement of an armature in telescopic relation to the pole. The attachment of the base and hub as an integral part of the assembly by means of this invention, that is by means of the sleeve and the winding of the turns of the coil thereon, provides an economical and efficient structure having superior heat dissipating characteristics. While the armature strips 28 in the wet plunger form may be advantageously formed of brass, they may also be formed of a low-friction carbon material, polytetrafluorethylene, such plastic material having particular advantage in supporting an armature in centered relation within the cylinder cavity in a dry embodiment. The axially extending portion **15*a* of a pole provides a region by which the pole is secured within the sleeve 16, and as noted above, if proportional actuation is not desired, the end cap portion 25*a* may be conventionally formed of magnetic material and be formed with any desired reach or depth within the cavity in relation to the axial extent of the portion 15*a*.**

While the form of apparatus herein described constitutes a preferred embodiment of this invention, it is to be understood that the invention is not limited to this precise form of apparatus, and that changes may be made therein without departing from the scope of the invention.

What is claimed is:

1. In a wet plunger solenoid in which an armature moves within a spool assembly defining an armature cavity subject to extreme hydraulic pressure from within, the improvement for reinforcing said assembly comprising a magnetic base having an inside surface forming at least an axial portion of the wall of said cavity, a sleeve of non-magnetic material fitted in telescopic relation to at least an axial portion of said base and having an outside coil receiving surface, a pole having a portion thereof telescopically received within said sleeve, and an electric coil wound in tension directly on said sleeve outside surface to cause said sleeve to be compressed about said base and pole for increasing the resistance of said assembly against deformation due to hydraulic pressure within.

2. The solenoid of claim 1 in which said sleeve defines a portion of said cavity axially between said base and said pole.

3. The solenoid of claim 1 in which said sleeve is formed of brass.

4. The solenoid of claim 1 in which said base is formed with a radial portion in abutment with one end of said sleeve and in which said pole is formed with a radial portion in abutment with the opposite end of said sleeve, said radial portions defining with said sleeve an annular coil cavity.

5. A wet plunger type solenoid comprising a non-ferrous generally tubular sleeve having an outer coil-receiving surface, a base formed of magnetic material telescopically received on an inside surface of said sleeve and having a shoulder extending radially outwardly of said sleeve forming one radial wall of a coil cavity, a pole of magnetic material telescopically received on said sleeve in spaced relation to said base and having a shoulder extending radially outwardly of said sleeve forming a second wall of a coil cavity, said pole and base having inside diameters defining an armature cavity subject to fluid pressure, an armature axially movable in said cavity, and an electric coil having turns wound in tension directly on said sleeve coil-receiving outer surface between said shoulders, said sleeve being compressed by said coil into firm engagement with said base and said pole forming fluid tight joints at the telescopic portions therebetween, and resisting deflection by reason of the application of fluid pressure to said coil cavity.

6. The solenoid of claim 5 in which said base and said pole are axially spaced and said sleeve is formed with an intermediate portion bridging the axial space therebetween.

* * * * *